US007905967B2

(12) United States Patent
Mori

(10) Patent No.: US 7,905,967 B2
(45) Date of Patent: Mar. 15, 2011

(54) METHOD OF MANUFACTURING MARTENSITIC STAINLESS STEEL

(75) Inventor: Nobuyuki Mori, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 528 days.

(21) Appl. No.: 11/905,191

(22) Filed: Sep. 28, 2007

(65) Prior Publication Data

US 2008/0078478 A1 Apr. 3, 2008

Related U.S. Application Data

(63) Continuation of application No. PCT/JP2006/306240, filed on Mar. 28, 2006.

(30) Foreign Application Priority Data

Mar. 30, 2005 (JP) ..... 2005-098221

(51) Int. Cl.
*C21D 8/10* (2006.01)
*C21D 8/00* (2006.01)

(52) U.S. Cl. ..... 148/593; 148/608; 148/653; 148/662; 148/663; 148/664; 148/503; 148/506

(58) Field of Classification Search ..... 148/592, 148/593, 608, 653, 325, 662–664, 503, 506
See application file for complete search history.

(56) References Cited

FOREIGN PATENT DOCUMENTS

| | | |
|---|---|---|
| EP | 1 099 772 | 5/2001 |
| JP | 58-025419 | 2/1983 |
| JP | 4-224659 | 8/1992 |
| JP | 05-171361 | 7/1993 |
| JP | 2003-64416 | 3/2003 |
| JP | 2004-043935 | 2/2004 |
| JP | 2004-285432 | 10/2004 |
| WO | 2004/007780 | 1/2004 |

OTHER PUBLICATIONS

Machine-English translation of Japanese patent 2003-105441, Yukio Miyata et al. Apr. 9, 2003.*

* cited by examiner

*Primary Examiner* — Deborah Yee
(74) *Attorney, Agent, or Firm* — Clark & Brody

(57) ABSTRACT

The occurrence of delayed fracture which is found in a hot worked martensitic stainless steel is prevented by subjecting the steel, after hot working and prior to heat treatment for hardening by quenching from a temperature of at least $Ac_1$ point of the steel, to preliminary softening heat treatment under such conditions that the softening parameter P defined below is at least 15,400 and the softening temperature T is lower than the $Ac_1$ point:

$$P(\text{softening parameter}):P=T(20+\log t)$$

T: softening temperature [K]

t: duration of softening treatment [Hr].

The present invention is particularly effective for a martensitic stainless steel having a steel composition in which the amount of effective dissolved C and N (=[C*+10N*]) where C* and N* are calculated by the following formulas is larger than 0.45:

$$C^*=C-[12\{(Cr/52)\times(6/23)\}/10, \text{ and}$$

$$N^*=N-[14\{(V/51)+(Nb/93)\}/10]-[14\{(Ti/48)+(B/11)+(Al/27)\}/10].$$

5 Claims, 1 Drawing Sheet

METHOD OF MANUFACTURING MARTENSITIC STAINLESS STEEL

This application is a continuation of International Patent Application No. PCT/JP2006/306240, filed Mar. 28, 2006. This PCT application was not in English as published under PCT Article 21(2).

TECHNICAL FIELD

This invention relates to a method of preventing delayed fracture in martensitic stainless steel which undergoes martensitic transformation even while it is allowed to cool in air and a method of manufacturing a martensitic stainless steel having such a property of preventing delayed fracture.

BACKGROUND ART

Steel pipes of martensitic stainless steel like API 13Cr-steel has excellent corrosion in a $CO_2$-containing atmosphere, and hence they are mainly used in oil well applications such as tubing and casing for use in excavation of oil wells. Martensitic stainless steel is hardened by quenching from a temperature in the austenite region (at a temperature equal to or above the $Ac_1$ point of the steel) to form a martensitic structure. Therefore, it is normally subjected to final heat treatment for hardening after hot working.

However, the high hardenability of a martensitic stainless steel may cause martensitic transformation of the steel even while it is allowed to cool in air after hot working such as pipe formation, and in some cases cracks develop particularly in those portions to which an impact has been applied during handling of the product. This phenomenon which is referred to as delayed fracture suddenly takes place after a certain period of time has passed from hot working. Therefore, for hot working of martensitic stainless steel, it is necessary to prevent the occurrence of delayed fracture during the period after hot working and prior to heat treatment for hardening.

In the manufacture of martensitic stainless steel pipes, a common countermeasure against delayed fracture is to limit the length of time from the completion of pipe formation up to the start of heat treatment for hardening by quenching. To do so, shortly after pipe formation, the resulting pipe must be subjected to heat treatment to provide the steel with sufficient strength by quenching. However, limiting the time from pipe formation until heat treatment sometimes makes it necessary to frequently change the heat treatment temperature during operation, leading to a decrease in manufacturing efficiency.

JP 2004-43935A described a martensitic stainless seamless pipe with suppressed delayed fracture by a technique based on restriction of the amount of effective dissolved C and N (which is defined below) to 0.45 or less. However, the amount of effective dissolved C and N is determined by the composition of a steel, and when an appropriate steel composition is selected by considering other properties such as strength and toughness, there are cases that the amount of effective dissolved C and N exceeds 0.45. Therefore, this technique cannot be said to be perfect for prevention of delayed fracture.

DISCLOSURE OF THE INVENTION

An object of the present invention is to provide a method for preventing delayed fracture of martensitic stainless steel which undergoes martensitic transformation even when it is allowed to cool in air, without limiting the length of time from the completion of hot working up to heat treatment for hardening.

Another object of the invention is to provide a method for preventing delayed fracture which is applicable to martensitic stainless steel having an amount of effective dissolved C and N exceeding 0.45.

A still another object of the invention is to provide a method for manufacturing a martensitic stainless steel having improved resistance to delayed fracture.

The present inventors made investigations with attention to the fact that a cause of delayed fracture in martensitic stainless steel resided in an increase in the material hardness and in the amount of occluded hydrogen both caused by dissolution of C and N in solid solution. As a result, they found that the occurrence of delayed fracture can be prevented by carrying out preliminary softening heat treatment after hot working. Subsequently, heat treatment for hardening can of course be carried out if necessary at any convenient time.

In one aspect, the present invention is a method for preventing delayed fracture of a martensitic stainless steel which undergoes a martensitic transformation when it is allowed to cool in air, characterized in that after hot working and prior to heat treatment by quenching from a temperature equal to or above the $Ac_1$ point of the steel, the steel is subjected to preliminary softening heat treatment under such conditions that the softening parameter P defined below is at least 15,400 and the softening temperature T is lower than the $Ac_1$ point:

$$P(\text{softening parameter}):P=T(20+\log t)$$

T: softening temperature [K]

t: duration of softening treatment [Hr].

In another aspect, the present invention is a method for manufacturing a martensitic stainless steel having improved resistance to delayed fracture, characterized in that a martensitic stainless steel consisting essentially of, in mass percent, C: 0.15-0.22%, Si: 0.05-1.0%, Mn: 0.10-1.0%, Cr: 10.5-14.0%, P: at most 0.020%, S: at most 0.010%, Al: at most 0.10%, Mo: 0-2.0%, V: at most 0.50%, Nb: 0-0.020%, Ca: 0-0.0050%, N: at most 0.1000%, and a remainder of Fe and impurities is subjected, after hot working, to preliminary softening heat treatment under such conditions that the softening parameter P defined above is at least 15,400 and the softening temperature T is lower than the $Ac_1$ point.

According to the present invention, in the manufacture of martensitic stainless steel pipes which are used in oil wells or the like, delayed fracture can be effectively prevented by subjecting them to preliminary softening heat treatment shortly after pipe formation, thereby making it possible to subsequently perform heat treatment for hardening by quenching at an arbitrary time to form final products. As a result, there is no need to perform quenching within a limited period of time after pipe formation, and it is possible to prevent delayed fracture of martensitic stainless steel without obstruction of manufacturing operations imposed by such limitation.

BEST MODE FOR CARRYING OUT THE INVENTION

Figure 1:
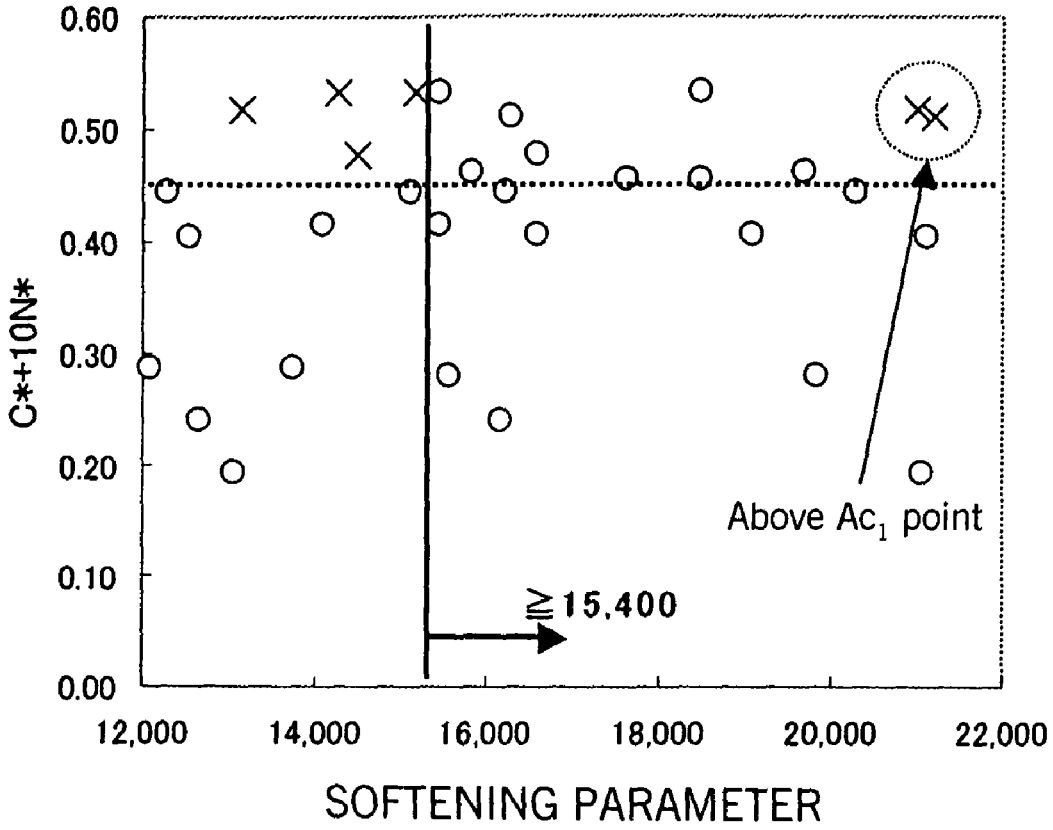
FIG. 1 is a graph showing the results of examples.

The present invention will be explained below in connection with some particular embodiments. However, the embodiments described below are merely intended to illustrate the present invention and not intended to restrict it.

A steel which is of interest in the present invention includes, in general, any martensitic stainless steel which undergoes martensitic transformation when it is allowed to cool in air.

However, in view of the main use of the steel as a steel pipe for use in an oil well, the following steel composition is preferred. In this specification, percent with respect to steel composition means mass percent unless otherwise indicated.

C: 0.15-0.22%

C (carbon) is one of the most important elements in martensitic stainless steel and is necessary to achieve a sufficient strength. The C content is in the range of 0.15-0.22% in order to obtain well balanced strength, yield ratio, and hardness. If the C content is less than 0.15%, a sufficient strength cannot be obtained. If it exceeds 0.22%, the strength becomes too high, it becomes difficult to achieve a suitable balance of the strength with the yield ratio and the hardness. In addition, it results in a significant increase in the amount of effective dissolved C which is defined below, and there are cases that delayed fracture cannot be prevented even if preliminary softening heat treatment is performed thereon according to the present invention. A preferred lower limit of the C content is 0.16% and a more preferred lower limit thereof is 0.18%.

Si: 0.05-1.0%

Si (silicon) is added as a deoxidizing agent for steel. In order to obtain this effect, at least 0.05% Si is added. In order to prevent a deterioration in toughness, its upper limit is 1.0%. Preferably the lower limit of Si content is 0.16% and more preferably it is 0.20%. A preferred upper limit of Si content is 0.35%.

Mn: 0.10-1.0%

Like Si, Mn (manganese) has a deoxidizing action. However, addition of too much Mn causes toughness to deteriorate. For this reason, the Mn content is 0.10-1.0%. Preferably it is at least 0.30%, and in order to maintain toughness after quenching, it is preferably at most 0.60%.

Cr: 10.5-14.0%

Cr (chromium) is a fundamental element for obtaining the necessary corrosion resistance in a martensitic stainless steel. By adding at least 10.5% Cr, corrosion resistance with respect to pitting and corrosion in time are improved, and corrosion resistance in a $CO_2$-containing environment is markedly increased. On the other hand, due to the fact that Cr is a ferrite-forming element, if its content exceeds 14.0%, δ ferrite forms easily during working at a high temperature, thereby causing hot workability to deteriorate and the strength after hot working to decrease. The Cr content is preferably at least 2.0% and at most 13.1%.

P: at most 0.020%

Since the presence of too much P (phosphorus) as an impurity causes toughness to deteriorate, the P content is at most 0.020%.

S: at most 0.010%

The presence of too much S (sulfur) as an impurity causes not only toughness to deteriorate but also segregation to develop resulting in worsening of the quality of the inner surface of a steel pipe. Therefore, the S content is at most 0.010%.

Al: at most 0.10%

Al is present in steel as an impurity. If its content exceeds 0.10%, toughness worsens, so the Al content is at most 0.10%. Preferably it is at most 0.05%.

Mo: 0-2.0%

Mo (molybdenum) is an optional alloying element, but if Mo is added, it has the effect of increasing strength and corrosion resistance. However, if the amount of Mo exceeds 2.0%, it becomes difficult for martensitic transformation to take place. Therefore, when added, the Mo content is at most 2.0%. Mo is an expensive alloying element, and addition of Mo in an increased amount is not efficient from an economic standpoint. Therefore, when it is added, its content is preferably made as small as possible.

V: at most 0.50%

Addition of V (vanadium) has the effect of increasing the YR (yield ratio=yield strength/tensile strength) of steel. However, if the V content exceeds 0.50%, it decreases toughness, so its upper limit is 0.50%. V is an expensive alloying element and addition of V in an increased amount is not efficient from an economic standpoint, so its upper limit is preferably 0.30%.

Nb: 0-0.020%

Nb (niobium) is an optional alloying element. If Nb is added, it has the effect of increasing strength. However, if the amount of Nb exceeds 0.020%, it decreases toughness, so the upper limit of Nb is 0.020%. Nb is also an expensive alloying element, and addition of Nb in an increased amount is not efficient from an economic standpoint. Therefore, when it is added, its content is preferably made as small as possible.

Ca: 0-0.0050%

Ca (calcium) is also an optional alloying element. Ca combines with S in the steel and has the effect of preventing hot workability from decreasing due to segregation of S in grain boundaries. If Ca exceeds 0.0050%, inclusions in the steel increase and toughness decreases. Therefore, when it is added, its upper limit is 0.0050%.

N: at most 0.1000%

N (nitrogen) is an austenite stabilizing element, and like C, it is an important element in a martensitic stainless steel, particularly in order to improve the hot workability. If the amount of N exceeds 0.1000%, toughness decreases. In addition, it results in a significant increase in the amount of effective dissolved N, and as a result it becomes very easy for delayed fracture to occur. Therefore, the upper limit of N is 0.100%, and it is preferably 0.0500%. On the other hand, if the amount of N is too small, the efficiency of a denitrification step in steel making process worsens, thereby impeding the productivity of the steel. Therefore, the amount of N is preferably at least 0.0100%.

A remainder of the steel composition other than the above elements comprises Fe and impurities such as Ti (titanium), B (boron), and O (oxygen).

As described in the aforementioned JP 2004-43935A, susceptibility to delayed fracture of a martensitic stainless steel is influenced by the amount of effective dissolved C and N in the steel. Delayed fracture tends to easily occur if the sum of the effective dissolved C and 10 times the effective dissolved N ($C^*+10N^*$) of the steel exceeds 0.45. Accordingly, the present invention exhibits its effects on a steel pipe for which the value of ($C^*+10N^*$) is greater than 0.45. In other words, in a steel with $(C^*+10N^*)\leqq 0.45$, delayed fracture does not occur easily.

Accordingly, a method according to the present invention is particularly effective when it is applied to a steel with $(C^*+10N^*)>0.45$. Namely, in contrast to the invention described in JP 2004-43935A, the present invention need not control the amount of N in a steel so as to meet the requirement $(C^*+10N^*)\leqq 0.45$. Thus, it is possible to sufficiently exploit the effect of N at improving hot workability, thereby facilitating hot working of martensitic stainless steel and favorably affecting the resulting hot worked products.

The amount of effective dissolved C and N (Q) is calculated as follows:

Q: Amount of effective dissolved C and N $$Q=C^*+10N^*$$

C*: Amount of effective dissolved C $$C^*=C-[12\{(Cr/52)\times(6/23)\}/10$$

N*: Amount of effective dissolved N $$N^*=N-[14\{(V/51)+(Nb/93)\}/10]-[14\{(Ti/48)+(B/11)+(Al/27)\}/10]$$

In the above formulas, each element indicates its content in mass percent.

According to the present invention, a martensitic stainless steel having a composition as described above is subjected, after hot working such as pipe formation, to preliminary softening heat treatment in order to prevent delayed fracture from occurring subsequently. The cause of delayed fracture of a martensitic stainless steel is nitrogen and hydrogen which are captured in strains which are introduced during hot working. Therefore, if these occluded gases are released, delayed fracture can be prevented. For this purpose, preliminary softening treatment is carried out under such conditions that the softening parameter P which is calculated by the following formula is at least 15,400 and the softening temperature T is lower than the $Ac_1$ point.

$$P(\text{softening parameter}):P=T(20+\log t)$$

T: softening temperature [K]

t: duration of softening treatment [Hr].

In order to prevent delayed fracture, it is necessary to decrease the amount of occluded hydrogen and nitrogen in steel. For this purpose, the hardness of the steel is decreased by softening heat treatment. If the softening parameter is less than 15,400 after the softening heat treatment, softening is inadequate, and even after carrying out softening heat treatment, there is the possibility of delayed fracture occurring. However, even in the case where the steel is heat treated so as to have a softening parameter of 15,400 or larger, if the softening temperature which is the temperature at which the softening heat treatment is carried out is equal to or greater than the $Ac_1$ point of the steel, the structure again becomes an austenite phase, and after cooling, a martensitic structure which has not undergone softening heat treatment appears so that delayed fracture tends to occur.

The preliminary softening heat treatment is carried out after hot working and before final heat treatment for hardening by quenching from a temperature of at least the $Ac_1$ point of the steel. It can be conducted any time within this period as long as delayed fracture has not occurred. However, since the possibility of delayed fracture occurring is increased after the time elapsed from the completion of the final hot working (e.g., pipe making) (excluding the subsequent cooling time) is 168 hours, it is preferable to perform preliminary softening heat treatment within 168 hours from the final hot working. Preliminary softening heat treatment may be carried out immediately after the final hot working. For example, it can be conducted immediately after the hot worked product is allowed to cool in air or even while it is being allowed to cool and after the temperature of the steel is decreased to the $M_f$ point of the steel at which martensitic transformation has been completed or lower.

The preliminary softening heat treatment is performed by heating the hot worked product to a softening temperature T which is lower than the $Ac_1$ point of the steel and maintaining the temperature for a certain period. The duration of this heat treatment is the duration of softening treatment "t" in the above formula, so it is selected depending on the softening temperature T such that the softening parameter P calculated by the above formula is at least 15,400. Cooling after softening heat treatment is preferably performed by allowing to cool in air.

After the preliminary softening heat treatment is performed on a hot worked martensitic stainless steel, the steel is reliably prevented from undergoing delayed fracture, so the final heat treatment for hardening by quenching can be performed at any convenient point of time. As a result, a plurality of hot worked steel products capable of being hardened by quenching from the same temperature can be consecutively subjected to the final heat treatment for hardening, thereby making it possible to reduce the temperature variations of a heat treatment furnace, and hence improve the manufacturing efficiency and save the operational costs.

As described above, the ease of occurrence of delayed fracture is influenced by the amount of effective dissolved C and N. According to the present invention, regardless of this amount (namely, even if the amount of effective dissolved C and N is considerably large), delayed fracture can be prevented.

Hot working and final heat treatment for hardening (quenching) of a martensitic stainless steel can be performed in a conventional manner. For example, hot working may be carried out by pipe formation under conditions which are generally employed in the manufacture of seamless pipes. Final heat treatment is generally performed by quenching from a temperature in the range of 920-980° C. and subsequent tempering in the temperature range of 650-750° C.

Example

Mannesmann pipe manufacture was carried out on billets of martensitic stainless steels having the compositions (balance: Fe and impurities) shown in Table 1 to form seamless steel pipes with 60.33 mm in outer diameter and 4.83 mm in wall thickness.

A test piece having a length of 250 mm was taken from each of the resulting seamless pipes for use in a drop weight test. A weight of 150 kg with a tip having a curvature of 90 mm was dropped onto each test piece from a height of 0.2 m to impart deformation from an impact load (294 J). Thereafter, the test piece was subjected to preliminary softening heat treatment under the two conditions (1) and (2) shown in Table 2 with respect to the temperature of the heat treating furnace (softening temperature) and the residence therein (duration of softening treatment). The value of softening parameter calculated from each condition is also shown in Table 2. The reason why the impact load was applied prior to preliminary softening heat treatment is for the purpose of simulating handling damage during transport of a steel pipe in an actual manufacturing process.

Each test piece which had been heat treated for softening was left in air for 720 hours, and the presence or absence of cracks was investigated. Cracks were ascertained by visual observation and ultrasonic testing. The results are shown in Table 2 and FIG. 1.

The amount of effective dissolved C and N (Q) in each steel was calculated by the following formulas and is shown in Table 1 along with its $Ac_1$ point:

$$Q=(C^*+10N^*)$$

$$C^*=C-[12\{(Cr/52)\times(6/23)\}/10, \text{ and}$$

$$N^*=N-[14\{(V/51)+(Nb/93)\}/10]-[14\{(Ti/48)+(B/11)+(Al/27)\}/10].$$

From FIG. 1, it can be seen that delayed fracture does not occur when $Q\leqq 0.45$, and when $Q>0.45$, delayed fracture can be prevented by making the softening parameter at least 15,400. Thus, in contrast with the teaching in JP 2004-43935 in which the condition of $Q\leqq 0.45$ must be satisfied in order to prevent delayed fracture, the present invention makes it possible to prevent delayed fracture even with steels having a Q value larger than 0.45.

TABLE 1

| No. | C | Si | Mn | P | S | Cr | Mo | V | Ti | Nb | Al | Ca | B | N | C* + 10N* | Ac1 point (° C.) |
|---|---|---|---|---|---|---|---|---|---|---|---|---|---|---|---|---|
| 1 | 0.19 | 0.42 | 0.92 | 0.019 | 0.0043 | 12.54 | 0.01 | 0.05 | 0.001 | 0.001 | 0.002 | 0.0003 | 0.0004 | 0.0371 | 0.461 | 807 |
| 2 | 0.16 | 0.37 | 0.47 | 0.019 | 0.0008 | 12.88 | 0.01 | 0.04 | 0.004 | 0.003 | 0.001 | 0.0023 | 0.0001 | 0.0393 | 0.455 | 799 |
| 3 | 0.16 | 0.27 | 0.36 | 0.013 | 0.0012 | 12.60 | 0.03 | 0.03 | 0.004 | 0.002 | 0.011 | 0.0007 | 0.0005 | 0.0472 | 0.510 | 801 |
| 4 | 0.19 | 0.24 | 0.90 | 0.013 | 0.0005 | 12.80 | 0.01 | 0.04 | 0.002 | 0.001 | 0.002 | 0.0053 | 0.0003 | 0.0387 | 0.479 | 807 |
| 5 | 0.19 | 0.23 | 0.88 | 0.014 | 0.0024 | 12.56 | 0.02 | 0.05 | 0.003 | 0.002 | 0.004 | 0.0008 | 0.0006 | 0.0451 | 0.533 | 807 |
| 6 | 0.19 | 0.22 | 0.73 | 0.012 | 0.0042 | 12.68 | 0.02 | 0.08 | 0.003 | 0.002 | 0.015 | 0.0012 | 0.0002 | 0.0471 | 0.518 | 809 |
| 7 | 0.20 | 0.21 | 0.78 | 0.012 | 0.0006 | 12.70 | 0 | 0.13 | 0.002 | 0.001 | 0.001 | 0.0007 | 0.0003 | 0.0453 | 0.533 | 808 |
| 8 | 0.18 | 0.34 | 0.08 | 0.010 | 0.0034 | 12.51 | 0.01 | 0.06 | 0.006 | 0.001 | 0.009 | 0.0020 | 0.0003 | 0.0391 | 0.445 | 806 |
| 9 | 0.17 | 0.31 | 0.40 | 0.018 | 0.0026 | 12.58 | 0.01 | 0.07 | 0.002 | 0.002 | 0.036 | 0.0014 | 0.0003 | 0.0304 | 0.281 | 805 |
| 10 | 0.19 | 0.28 | 0.51 | 0.016 | 0.0009 | 12.89 | 0.02 | 0.03 | 0.001 | 0.001 | 0.012 | 0.0003 | 0.0006 | 0.0219 | 0.286 | 808 |
| 11 | 0.20 | 0.30 | 0.88 | 0.020 | 0.0012 | 12.53 | 0.01 | 0.07 | 0.001 | 0.001 | 0.036 | 0.0003 | 0.0001 | 0.0394 | 0.404 | 809 |
| 12 | 0.18 | 0.23 | 0.67 | 0.013 | 0.0005 | 12.55 | 0 | 0.04 | 0.003 | 0.002 | 0.002 | 0 | 0.0002 | 0.0157 | 0.239 | 803 |
| 13 | 0.17 | 026 | 0.89 | 0.014 | 0.0010 | 12.50 | 0 | 0.17 | 0.001 | 0 | 0.016 | 0.0026 | 0.0007 | 0.0443 | 0.444 | 798 |
| 14 | 0.20 | 0.22 | 0.92 | 0.015 | 0.0009 | 12.50 | 0.02 | 0.13 | 0.002 | 0 | 0.010 | 0.0005 | 0.0012 | 0.0364 | 0.417 | 807 |
| 15 | 0.19 | 0.27 | 0.59 | 0.016 | 0.0031 | 12.61 | 0 | 0.05 | 0.012 | 0.001 | 0.046 | 0.0013 | 0.0009 | 0.0236 | 0.194 | 805 |
| 16 | 0.20 | 0.22 | 0.52 | 0.014 | 0.0005 | 13.00 | 0 | 0.05 | 0.003 | 0.001 | 0.003 | 0.0004 | 0.0002 | 0.0313 | 0.407 | 808 |

TABLE 2

| | | Conditions for softening heat treatment (1) | | | | | Conditions for softening heat treatment (2) | | | | |
|---|---|---|---|---|---|---|---|---|---|---|---|
| No. | C* + 10N* | Temperature (° C.) | Duration (min) | Softening parameter | Test results | | Temperature (° C.) | Duration (min) | Softening parameter | Test results | |
| 1 | 0.461 | 550 | 10 | 15820 | ○ | This | 730 | 25 | 19679 | ○ | This |
| 2 | 0.455 | 630 | 20 | 17629 | ○ | invention | 705 | 5 | 18505 | ○ | invention |
| 3 | 0.510 | 560 | 20 | 16263 | ○ | | 820 | 15 | 21202 | X | Compar. |
| 4 | 0.479 | 480 | 10 | 14474 | X | Comparative | 590 | 10 | 16588 | ○ | This |
| 5 | 0.533 | 500 | 25 | 15166 | X | | 680 | 15 | 18486 | ○ | invention |
| 6 | 0.518 | 400 | 20 | 13139 | X | | 810 | 15 | 21008 | X | Compar. |
| 7 | 0.533 | 450 | 30 | 14242 | X | | 530 | 10 | 15435 | ○ | Inventive |
| 8 | 0.445 | 360 | 15 | 12279 | ○ | | 500 | 20 | 15091 | ○ | Comparative |
| 9 | 0.281 | 520 | 25 | 15558 | ○ | | 750 | 15 | 19844 | ○ | |
| 10 | 0.286 | 350 | 15 | 12085 | ○ | | 430 | 20 | 13725 | ○ | |
| 11 | 0.404 | 380 | 10 | 12552 | ○ | | 790 | 45 | 21127 | ○ | |
| 12 | 0.239 | 380 | 15 | 12667 | ○ | | 560 | 15 | 16158 | ○ | |
| 13 | 0.444 | 550 | 30 | 16212 | ○ | | 800 | 5 | 20302 | ○ | |
| 14 | 0.417 | 460 | 10 | 14090 | ○ | | 500 | 60 | 15460 | ○ | |
| 15 | 0.194 | 390 | 30 | 13060 | ○ | | 780 | 60 | 21060 | ○ | |
| 16 | 0.407 | 590 | 10 | 16588 | ○ | | 700 | 25 | 19090 | ○ | |

The invention claimed is:

1. A method for manufacturing a martensitic stainless steel comprising the steps of:

hot working a steel composition;

cooling the hot-worked steel to a temperature lower than the Ms point to form a martensitic steel;

carrying out preliminary softening heat treatment to the resulting martensitic steel;

heating the resulting steel to a temperature equal to or above the $Ac_1$ point of the steel;

quenching by cooling the steel from the temperature equal to or above the $Ac_1$ point of the steel; and, tempering the resulting quenched steel, said preliminary softening heat treatment is carried out under such conditions that the softening parameter P defined below is at least 15,400 and the softening temperature T is lower than the $Ac_1$ point:

$$P(\text{softening parameter}):P=T(20+\log t)$$

T: softening temperature [K]

t: duration of softening treatment [Hr], wherein the martensitic stainless steel has a steel composition consisting essentially of, in mass percent, C: 0.15-0.22%, Si: 0.05-1.0%, Mn: 0.10-1.0%, Cr: 10.5-14.0%, P: at most 0.020%, S: at most 0.010%, Al: at most 0.10%, Mo: 0-2.0%, V: at most 0.50%, Nb: 0-0.020%, Ca: 0-0.0050%, N: at most 0.1000%, and a remainder of Fe and impurities and the steel composition is such that the amount of effective dissolved C and N ([C*+10N*]) where C* and N* are calculated by the following formulas is larger than 0.45:

$$C^*=C-[12\{(Cr/52)\times(6/23)\}/10], \text{ and}$$

$$N^*=N-[14\{(V/51)+(Nb/93)\}/10]-[14\{(Ti/48)+(B/11)+(Al/27)\}/10].$$

2. A method for manufacturing a martensitic stainless steel as set forth in any of claim 1 wherein the preliminary softening heat treatment is performed within 168 hours after final hot working.

3. A method for manufacturing a martensitic stainless steel as set forth in claim 2 wherein the hot working is pipe formation.

4. A method of manufacturing a martensite steel as set forth in claim 1 wherein the quenching is carried out by heating to a temperature of 920-980° C. and cooling the martensite steel.

5. A method of manufacturing a martensite steel a set forth in claim 4 wherein the tempering is carried out by heating the martensite steel to a temperature of 650-750° C.

* * * * *